United States Patent [19]

Arai et al.

[11] 4,258,685

[45] Mar. 31, 1981

[54] CARBURETOR FOR INTERNAL COMBUSTION ENGINES

[75] Inventors: Hisaharu Arai, Nagoya; Masami Sato; Kunio Kadowaki, both of Oobu, all of Japan

[73] Assignee: Aisan Industry Co., Ltd., Ohbu, Japan

[21] Appl. No.: 34,668

[22] Filed: Apr. 30, 1979

[30] Foreign Application Priority Data

May 9, 1978 [JP] Japan ..... 53-61970[U]

[51] Int. Cl.[3] ..... F02M 33/02

[52] U.S. Cl. ..... 123/520; 261/72 R; 261/DIG. 67

[58] Field of Search ..... 123/136, DIG. 2; 261/DIG. 67, 72 R

[56] References Cited

U.S. PATENT DOCUMENTS

| | | | |
|---|---|---|---|
| 3,273,871 | 9/1966 | Winkler | 261/DIG. 67 |
| 3,368,326 | 2/1968 | Hervert | 123/136 |
| 3,456,635 | 7/1969 | Hervert | 123/136 |
| 3,460,522 | 8/1969 | Kittler et al. | 123/136 |
| 3,575,152 | 4/1971 | Wentworth | 123/136 |
| 3,782,351 | 1/1974 | Rogerson | 123/136 |
| 4,085,721 | 4/1978 | Vardi et al. | 123/136 |
| 4,175,526 | 11/1979 | Phelan | 123/136 |

FOREIGN PATENT DOCUMENTS 1217347 12/1970 United Kingdom ..... 123/136

*Primary Examiner*—Ira S. Lazarus
*Assistant Examiner*—Magdalen Moy
*Attorney, Agent, or Firm*—Cushman, Darby & Cushman

[57] ABSTRACT

A carburetor for internal combustion engines includes an inner vent passage through which the space on the free surface of liquid fuel in a float chamber is communicated with the intake passage of the carburetor and an outer vent passage through which the space in the float chamber is communicated with a charcoal canister adapted to store the fuel vapor coming from the space of the float chamber. A valve is movable between a first position in which the inner vent passage is closed and the outer vent passage is opened and a second position in which the inner vent passage is opened and the outer vent passage is closed. A pressure responsive valve actuator normally holds the valve in the first position and moves the valve to the second position as a vacuum is generated in the intake passage. A further valve actuator holds the valve in the second position regardless of the action of the pressure-responsive valve actuator on the valve when the throttle valve has been opened to and beyond a predetermined opening.

5 Claims, 2 Drawing Figures

CARBURETOR FOR INTERNAL COMBUSTION ENGINES

BACKGROUND OF THE INVENTION

1. Field of the Invention

The present invention relates to a carburetor for internal combustion engines and, more particularly, to a carburetor in which the flow of the vapor evaporated from a liquid fuel in the float chamber is suitably controlled to prevent loss of fuel and environmental contamination.

2. Description of the Prior Art

A typical conventional carburetor for internal combustion engines, which is designed to control the flow of fuel vapor filling the space on the free surface of liquid fuel in a float chamber, includes an inner vent passage through which the space in the float chamber is communicated with the intake passage of the carburetor, an outer vent passage through which the space in the float chamber is communicated with a vessel for storing the fuel vapor such as a charcoal canister, and a solenoid valve adapted to open and close the outer vent passage as its coil is energized and de-energized in accordance with the operation of engine ignition key. In this conventional carburetor, since the inner vent passage is always opened, a part of the fuel vapor is inconveniently relieved or discharged to the intake passage during the engine-off period, resulting in a contamination of the air cleaner and starting failure of the engine. In addition, it is impossible to absorb all of the fuel vapor in the charcoal canister during the engine-off period, because a considerable part of the evaporated fuel is relieved to the intake passage.

To avoid such drawbacks, there has been proposed a carburetor having a valve adapted to operate in response to the vacuum in the intake passage, in such a manner that it normally closes and opens the inner and outer vent passages, respectively, and opens and closes the inner and outer vent passages, respectively, when a vacuum is generated in the intake passage. In this carburetor, however, the inner and outer vent passages are inconveniently closed and opened, respectively, when the vacuum in the intake passage has become low during running operation of engine so that the function of the inner vent passage is failed.

SUMMARY OF THE INVENTION

It is therefore a major object of the invention to provide a carburetor which can ensure the opening of the inner vent passage and closing of the outer vent passage during running of the engine irrespective of the engine speed and the level of the load applied to the engine.

To this end, according to the invention, there is provided a carburetor for internal combustion engines, comprising: a carburetor body having therein an intake passage and a float chamber, the float chamber receiving therein a liquid fuel with a space left on the free surface of the fuel; a throttle valve within the intake passage for opening and closing the same; a first vent passage having one end thereof opening to the intake passage and the other end communicating with the space within the float chamber; a second vent passage having one end thereof communicating with the space within the float chamber and the other end adapted to communicate with a container for receiving therein fuel vapor from the space within the float chamber; valve means movable between a first position in which the first vent passage is closed and the second vent passage is opened and a second position in which the first vent passage is opened and the second vent passage is closed; means for generating pressure signals in accordance with the conditions of the engine operation; first actuating means operative in response to the pressure signals from the signal generating means to normally cause the valve means to move into the first position and to cause the valve means to move into the second position during the engine running operation; and second actuating means operative in response to the opening and closing movements of the throttle valve for actuating the valve means to retain the valve means in the second position, regardless of the action of the first actuating means on the valve means when the throttle valve reaches a predetermined opening degree.

DESCRIPTION OF THE PREFERRED EMBODIMENTS

Figure 1:
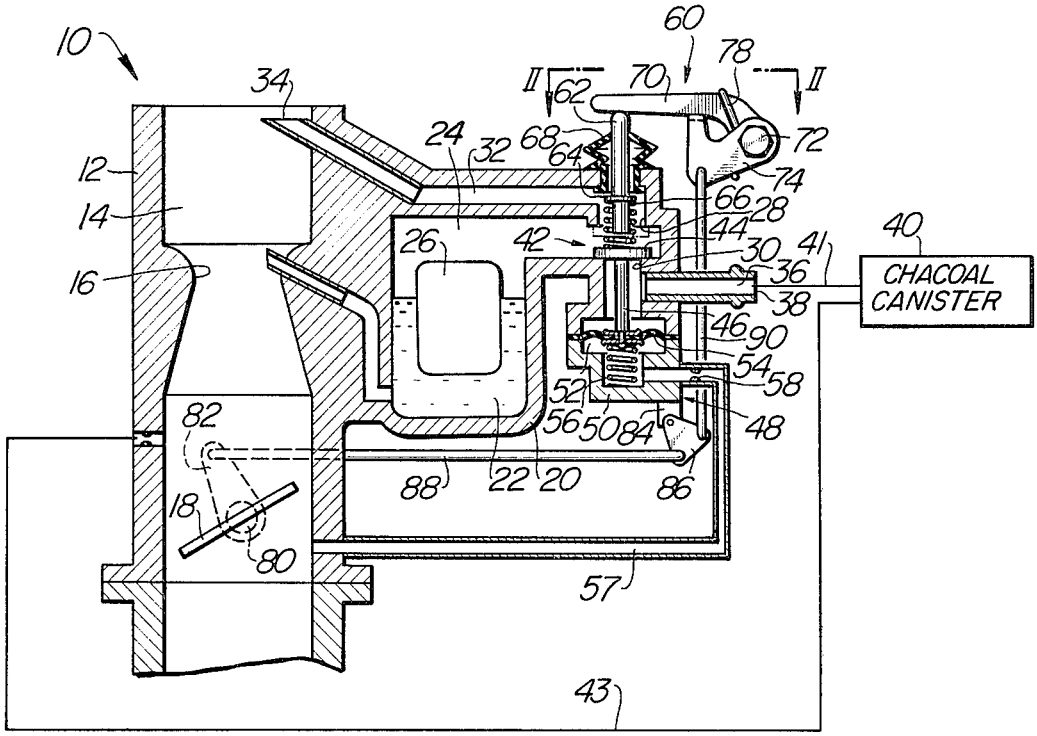
FIG. 1 is a schematic sectional view of a carburetor embodying the present invention.

Referring to the drawings, a carburetor embodying the invention is generally designated at a reference numeral 10. The carburetor 10 has a carburetor body 12 having therein an intake passage 14 through which an air cleaner (not shown) is communicated with an intake manifold (not shown). The intake passage 14 is provided with a venturi 16. A pivotable throttle valve 18 is disposed in the intake passage 14 at the downstream side of the venturi 16.

The carburetor body 12 is provided therein with a float chamber 20 which receives a liquid fuel 22 with a space 24 left on the free surface of the liquid fuel. The space 24 is filled with fuel vapor evaporated from the liquid fuel. A float 26 disposed in the float chamber 20 is adapted to deliver a signal concerning the fuel level to a fuel meter which is not shown. A pair of ports 28, 30 are formed in the wall of the float chamber 20. These ports 28, 30 are spaced from and opposed to each other, and opens to the space 24 in the float chamber 20.

An inner vent passage 32 has one end 34 opening in the intake passage 14 at the upstream side of the venturi 16, and the other end communicating with the upper port 28 of the pair of ports 28 and 30 so as to provide a communication between the intake passage 14 and the space 24 in the float chamber 20. An outer vent passage 36 has one end communicating with the lower port 30 of the pair of ports 28 and 30 and the other end 38 which is in communication with, through a conduit 41, a container containing an absorbent such as activated charcoal for adsorbing and storing the fuel vapor, such as a charcoal canister 40, so as to make the charcoal canister 40 and the space 24 in the float chamber 20 communicate with each other. The charcoal canister 40 is in communication with the intake passage 14, through a conduit 43.

A valve generally denoted by a numeral 42 is associated with the aforementioned pair of ports 28, 30. The valve 42 is adapted to move between a first position shown by imaginary lines in which the upper and lower ports 28, 30 are closed and opened, respectively, and a second position shown by the solid lines in which the upper and lower ports 28, 30 are opened and closed, respectively. The valve 42 has a valve head 44 movable between the pair of ports 28, 30 and a valve stem 46 which is connected at one end to the valve head 44 and extending through the lower port 30 coaxially with the latter.

A first valve actuator 48 is associated with the valve 42 for actuating the same in response to a pressure signal. The first valve actuator 48 include a housing 50 and a diaphragm 54 disposed within the housing 50 to define a pressure chamber 52 in the housing 50. The aforementioned valve stem 46 is connected at its other end to the diaphragm 54. A spring 56 disposed in the pressure chamber 52 is adapted to normally bias the diaphragm 54 so as to position the valve 42 in a first position in which the valve head 44 closes the upper port 28. The pressure chamber 52 is communicated, through a conduit 57, with the portion of the intake passage 14 downstream of the throttle valve 18, so that the pressure established in that portion of the intake passage 14 is transmitted to the pressure chamber 52. Thus, the intake passage 14 constitutes means for generating a pressure signal for the first valve actuator 48. A restriction 58 is disposed in one end of the conduit 57 to control the pressure of the fluid passing therethrough.

As the throttle valve 18 is opened during running of the engine, a vacuum is generated in the intake passage 14. This vacuum is introduced through the conduit 57 into the pressure chamber 52 of the first valve actuator 48 to deflect the diaphragm 54 overcoming the force of the spring 56. As a result, the valve 42 is moved from the first position shown by imaginary lines in which the valve head 44 closes the upper port 28 and opens the lower port 30, to the second position shown by the solid line in which the valve head 44 opens and closes, respectively, the upper and lower ports 28, 30.

A second valve actuator 60 is further associated with the valve 42 and has an actuating member such as a push rod 62 extending through the upper port 28 coaxially with the latter. The push rod 62 has one end confronting the opposite side of the valve head 44 to the valve stem 46, and the other end remote from the valve stem and extending to the outside of the carburetor body 12. The push rod 62 has an annular flange 64 which extends radially outwardly from an intermediate portion of the push rod 62. A spring 66 is disposed concentrically with the push rod 62 so as to act between the flange 64 and the surface of the valve head 44 confronting the push rod 62, thereby to bias the push rod 62 away from the valve head 44. The projecting end of the push rod 62 is enclosed and sealed by a bellows 68 to prevent foreign matters from coming into the float chamber 20.

Figure 2:
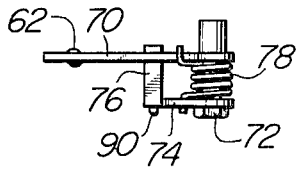
FIG. 2 shows a part of the carburetor as viewed from the direction shown in the arrows II—II of FIG. 1, with the body of the carburetor neglected.

The second valve actuator 60 has, as will be most clearly seen from FIG. 2, a lever 70 having one end engageable with the projecting end of the push rod 62, and pivoted at its other end by a pivot shaft 72. The pivot shaft 72 carries another level 74 which is spaced from the first lever 70 in the axial direction of the pivot shaft 72. The lever 74 is provided with an arm 76 which extends under the lever 70, in parallel with the pivot shaft 72. A spring 78 wound around the pivot shaft 72 is adapted to act between the pair of levers 70, 74. This spring 78 is preloaded to rotatively bias the levers 70, 74 toward each other, thereby to bring the arm 76 of the lever 74 into pressure contact with the lower surface of the lever 70.

The second valve actuator 60 is further provided with a link mechanism which connects the free end of the lever 74 to the free end of a lever 82 fixed to a pivot shaft 80 of the throttle valve 18, so that the movement of the throttle valve 18 in the opening and closing directions is converted into a pivotal movement of the lever 74. More specifically, the link mechanism includes a link 88 through which the free end of the lever 82 is connected to one of the apieces of a bell crank 86 which is pivotally mounted on a bracket 84 which in turn is fixed to the housing 50 of the first valve actuator 48, and also a link 90 through which the free end of the lever 74 is connected to another apex of the bell crank 86.

In operation, during the engine-off period, the throttle valve 18 is kept closed and no vacuum is generated in the intake passage 14. Under this normal condition, the diaphragm 54 of the first valve actuator 48 is urged by the spring 56 to actuate the valve 42 so as to move the valve head 44 to the first position where it closes the upper port 28 and opens the lower port 30. As a result, the fuel vapor evaporated from the liquid fuel in the float chamber 20 and filling the space 24 of the float chamber is delivered to the charcoal canister 40, through the lower port 30, outer vent passage 36 and then through the conduit 41, and adsorbed and stored by the activated charcoal particles in the canister 40.

As the engine is started, the throttle valve 18 is opened and a vacuum is generated in the intake passage 14. The vacuum generated in the intake passage 14 is transmitted through the conduit 57 to the pressure chamber 52 of the first valve actuator 48, and deflects the diaphragm 54 against the force of the spring 56. Consequently, the valve 42 is moved to the illustrated second position where the valve head 44 opens the upper port 28 and closes the lower port 30. The fuel vapor in the space 24 of the float chamber 20 is then induced into the intake passage 14, through the upper port 28 and the inner vent passage 32. At the same time, the fuel vapor which has been trapped or stored by the charcoal canister 40 is induced, due to the vacuum generated in the intake passage 14, through the conduit 43 into the intake passage and further into the engine, so that the charcoal canister 40 is cleaned.

In an engine operating condition in which the throttle valve 18 is further opened, and the vacuum in the intake passage 14 lowers, the spring 56 of the first valve actuator 48 tends to force the valve 42 from the second position back to the first position. However, the motion of the throttle valve 18 is converted into a pivotal movement of the lever 74 around the axis of the pivot shaft 72 in the counter-clockwise direction as viewed on the drawing, through the lever 82 fixed to the pivot shaft 80 of the throttle valve, link 88, bell crank 86 and the link 90.

The lever 70 is pivotally moved also in the counter-clockwise direction, following up the movement of the lever 74, through the action of the spring 78. Consequently, the free end of the lever 70 comes into engagement with the projecting end of the push rod 62, so as to depress the latter toward the valve head 44, overcoming the force of the spring 66.

As the throttle valve 18 is opened to a predetermined degree of opening, the push rod 62 depresses the valve head 44 toward the lower port 30, so as to move the valve 42 to the second position where the valve head 44 closes the lower port 30. Therefore, during the running of engine, even if the level of the vacuum in the intake passage is lowered, once the throttle valve 18 is opened to a predetermined opening degree, the second valve actuator 60 acts to retain the valve 42 in the illustrated second position, regardless of the action of the first valve actuator 48 on the valve 42.

As will be understood from the foregoing description, in the carburetor in accordance with the invention, the second valve actuator retains the valve in the second position where it opens and closes, respectively, the upper and the lower ports, regardless of the engine speed and the level of the load, once the throttle valve has reached a predetermined opening degree during running of the engine, thereby to ensure the safe functioning of the inner vent passage 32. In addition, since the fuel vapor in the float chamber is introduced into the charcoal canister during the engine-off period, no direct emission of the fuel vapor to the atmosphere is allowed, thereby to prevent the contamination of the atmosphere. In addition since the fuel vapor is prevented from flowing into the intake passage during the engine-off period, the starting failure of the engine attributable to the accumulation of fuel vapor in the intake passage is fairly avoided.

What is claimed is:

1. A carburetor for internal combustion engines, comprising:

a carburetor body having therein an intake passage and a float chamber, said float chamber receiving therein a liquid fuel with a space left on the free surface of the fuel and including a pair of opposed and spaced ports opening to said space in said float chamber;

a throttle valve within said intake passage for opening and closing the same;

a first vent passage having one end thereof opening to said intake passage and an other end communicating with said space within said float chamber, a first one of said ports being in communication with said other end of said first vent passage;

a second vent passage having one end thereof communicating with said space within said float chamber and an other end adapted to communicate with a container for receiving therein fuel vapor from said space within said float chamber, a second one of said ports being in communication with said one end of said second vent passage;

valve means movable between a first position in which said first vent passage is closed and said second vent passage is opened and a second position in which said first vent passage is opened and said second vent passage is closed; said valve means including a valve head movable between said first and second ports, said valve head being adapted to close said first port when said valve means is positioned in said first position and to close said second port when said valve means is positioned in said second position; said valve means further including a valve stem connected at one end to said valve head and extending through said second port and coaxial therewith;

means for generating pressure signals in accordance with the conditions of the engine operation, said means for generating pressure signals being provided by said intake passage;

first actuating means operative in response to pressure signals from said pressure signal generating means to normally cause said valve means to move into said first position and to cause said valve means to move into said second position during an engine running operation; said first actuating means including a housing, a diaphragm disposed within said housing for defining a pressure chamber in said housing, an other end of said valve stem being connected to said diaphragm, and a spring for normally biasing said diaphragm in such a direction that said valve head closes said first port, an introduction of vacuum in said intake passage and thereby into said pressure chamber causing said diaphragm to bias said valve against the force of said spring to close said second port; and second actuating means operative in response to opening and closing movements of said throttle valve for actuating said valve means to retain said valve means in said second position, regardless of the action of said first actuating means on said valve means, when said throttle valve reaches a predetermined opening degree; said second actuating means including a movable actuating member associated with said valve head, and a link mechanism connecting said throttle valve and said movable actuating member with each other to convert the opening and closing movements of said throttle valve into movement of said actuating member, in which said actuating member presses said valve head against said second port to keep said second port closed when said throttle valve reaches said predetermined opening degree; said movable actuating member comprising an elongated push rod disposed in coaxial relation to said first port, said push rod having one end opposed said valve head and an other end remote from said valve head; and said second actuating means further including a spring for biasing said push rod away from said valve head, and a lever having one end thereof engageable with said other end of said push rod and an other end thereof pivotable around a pivot, said link mechanism being connected to said lever so as to cause a pivotal movement of said lever around an axis of said pivot during the opening and closing movement of said throttle valve, thereby bringing said one end of said lever into engagement with said other end of said push rod to move said other end of said push rod toward said valve head.

2. A carburetor as claimed in claim 1, wherein said pressure chamber communicates with said intake passage at the downstream side of said throttle valve.

3. A carburetor for internal combustion engines, comprising:

a carburetor body including an air intake passage and a float chamber for receiving fuel therein, said fuel being in a liquid phase and a gaseous phase therein;

a pair of opposed coaxial ports, separated by a predetermined distance, opening into a space occupied by said gaseous phase;

a throttle valve controllably disposed within said intake passage;

a first vent passage for connecting a first one of said ports to said air intake passage;

a second vent passage for connecting a second one of said ports to a fuel vapor absorption device;

a valve movably disposed between and coaxial with said first and second ports, said valve being effective to controllably close one of said ports and open the other of said ports substantially concurrently;

valve control means responsive to pressure conditions indicative of a particular engine operating condition for positioning said valve so as to open said first port and close said second port, and otherwise for positioning said valve so as to close said first port and open said second port, an elongated push rod coaxially disposed with respect to said first port and having an end thereof opposed said valve and another end thereof resistively linked to said throttle, a spring being effective to bias said push rod away from said valve when said throttle is within a first predetermined degree-of-opening range to permit the position of said valve to be controlled by said valve control means, and resistively engaging said valve when said throttle is within a second predetermined degree-of-opening range to maintain said first port open and said second port closed, thereby suppressing the positioning function of said valve control means.

4. The carburetor as in claim 3, wherein said particular engine operating condition occurs when said throttle is no greater than partly opened.

5. The carburetor as in claim 3, wherein said elongated push rod is resistively engaged by a lever linked to said throttle by a link mechanism.

* * * * *